US007849910B2

(12) United States Patent
Graham

(10) Patent No.: US 7,849,910 B2
(45) Date of Patent: Dec. 14, 2010

(54) METHOD AND APPARATUS FOR CASTING METAL ARTICLES

(75) Inventor: Lawrence D. Graham, Chagrin Falls, OH (US)

(73) Assignee: PCC Airfoils, Inc., Beachwood, OH (US)

( * ) Notice: Subject to any disclaimer, the term of this patent is extended or adjusted under 35 U.S.C. 154(b) by 391 days.

(21) Appl. No.: 12/137,971

(22) Filed: Jun. 12, 2008

(65) Prior Publication Data

US 2009/0308560 A1 Dec. 17, 2009

(51) Int. Cl.
*B22D 27/04* (2006.01)
*B22D 5/02* (2006.01)

(52) U.S. Cl. ..... 164/128; 164/130; 164/325; 164/326

(58) Field of Classification Search ..... 164/61, 164/66.1, 122, 128, 130, 253, 254, 256, 258, 164/259, 324, 325, 326
See application file for complete search history.

(56) References Cited

U.S. PATENT DOCUMENTS

| | | | | |
|---|---|---|---|---|
| 2,672,661 | A * | 3/1954 | Lutz | 164/326 |
| 3,658,119 | A | 4/1972 | Hunt et al. | |
| 3,841,384 | A | 10/1974 | Tingquist et al. | |
| 4,055,216 | A * | 10/1977 | Ulyanov et al. | 164/258 |
| 5,860,468 | A | 1/1999 | Cook | |
| 6,523,598 | B2 | 2/2003 | Shaffer | |

* cited by examiner

*Primary Examiner*—Kevin P Kerns
(74) *Attorney, Agent, or Firm*—Tarolli, Sundheim, Covell & Tummino LLP

(57) ABSTRACT

A plurality of molds are disposed on a rotatable base. The base is rotated to move each of the molds in turn through a pouring station to an article removing station and back to the pouring station. A molten nickel chrome super alloy is poured into each of the molds in turn at the pouring station. The molds are cooled by a flow of cooling fluid. The nickel chrome super alloy articles are removed from the molds at the article removal station. The base may be continuously or intermittently rotated relative to the pouring station. Molten metal may be continuously or intermittently poured at the pouring station.

22 Claims, 6 Drawing Sheets

METHOD AND APPARATUS FOR CASTING METAL ARTICLES

BACKGROUND OF THE INVENTION

The present invention relates to a new and improved method and apparatus for use in casting nickel chrome super alloy articles.

During the casting of nickel chrome super alloy articles, such as turbine engine components, waste or scrap metal is formed. For example, this scrap metal can be formed in a gating system which is connected with the article mold cavities. Due to the relatively high cost of nickel chrome super alloy metals, this scrap metal is recast and subsequently used to charge a crucible during a casting of metal articles of many different types.

One known method of recasting scrap nickel chrome super alloy metal has been to melt the scrap metal and pour it into pipes. The ingot which is cast in a pipe may be forced from the pipe utilizing a hydraulic ram. During this casting process, there is usually a certain amount of waste of the scrap metal. Due to the high cost of the nickel chrome super alloy scrap metal, the elimination of even a small amount of waste is economically advantageous.

SUMMARY OF THE INVENTION

The present invention relates to a method of casting nickel chrome super alloy articles. A plurality of molds are disposed on a rotatable base. The base is rotated to move each of the molds, in turn, through a pouring station to an article removal station and back to the pouring station. A molten nickel chrome super alloy is poured into each of the molds in turn at the pouring station. Cast nickel chrome super alloy articles are removed from the molds at the article removal station.

The molds may be continuously rotated. Molten metal may be continuously poured into the molds as they are rotated. Deflectors may be associated with the molds to deflect molten metal during rotation of the molds and pouring of the molten metal. Alternatively, the molds may be intermittently rotated. If this is done, molten metal would be poured while the molds are stationary.

The present invention includes a plurality of features which may be utilized together in the manner described herein. These features may also be used separately and/or in combination with features from the prior art.

BRIEF DESCRIPTION OF THE DRAWINGS

The foregoing and other features of the present invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
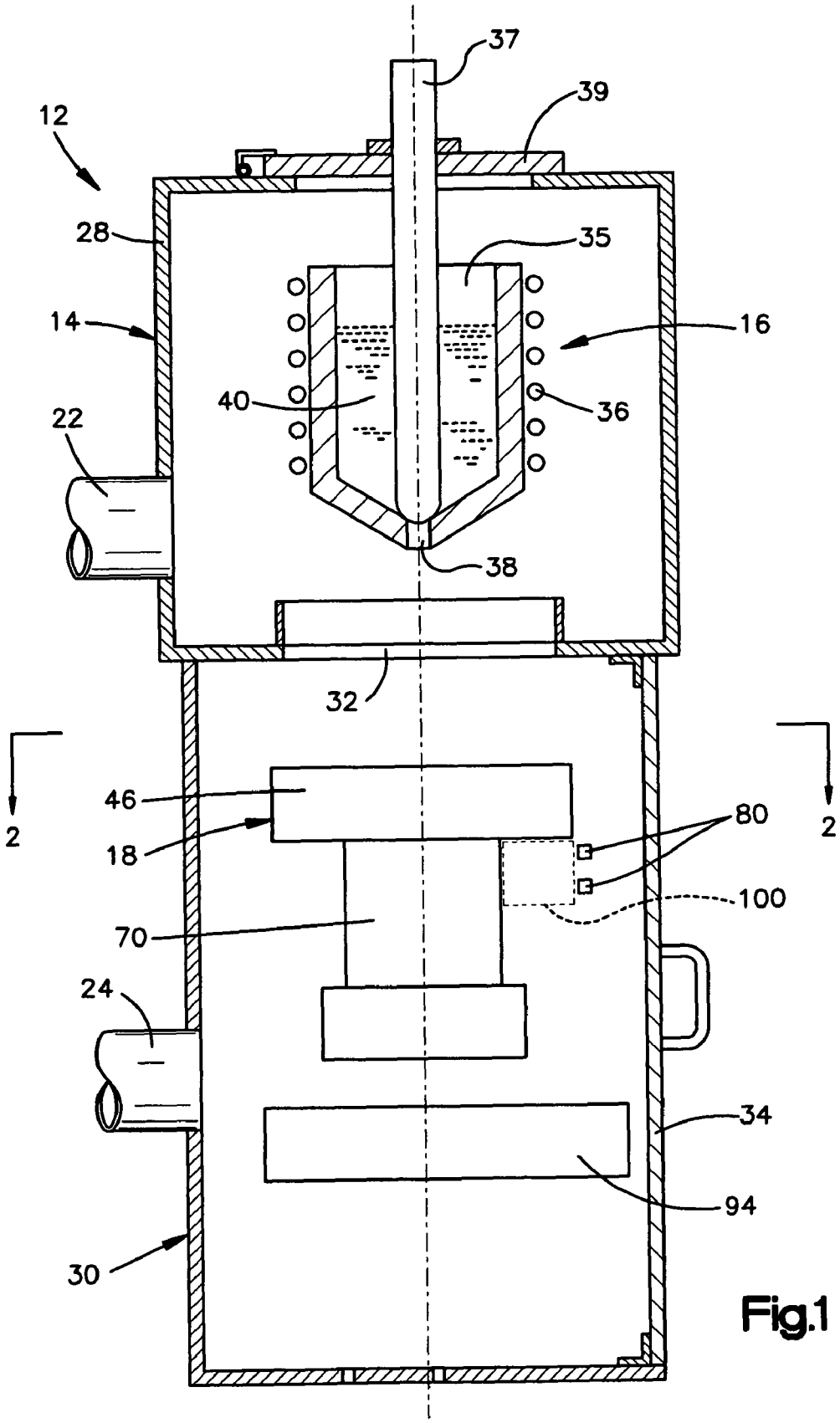
FIG. 1 is a fragmentary schematic sectional view illustrating the relationship of a housing assembly to a crucible from which molten metal is poured into a casting apparatus.

An apparatus 12 for use in casting nickel chrome super alloy articles is illustrated schematically in FIG. 1. The apparatus 12 includes a housing assembly 14 which encloses a crucible 16 and a casting apparatus 18. The housing assembly 14 is connected in fluid communication with a source of low pressure (vacuum) through valves (not shown) and conduits 22 and 24.

The valves are operable to a first condition to connect the conduits 22 and 24 in fluid communication with the source of low pressure. The valves are also operable to a second condition to connect the conduits 22 and 24 with atmospheric or ambient pressure to vent the housing assembly 14. If desired, the conduits 22 and 24 may be connected with a source inert gas, such as argon rather than a source of low pressure (vacuum).

The housing assembly 14 has a known construction. The illustrated housing assembly 14 is similar to the housing assembly disclosed in U.S. Pat. No. 3,841,384. The disclosure in the aforementioned U.S. Pat. No. 3,841,384 is hereby incorporated herein in its entirety by this reference thereto. However, it should be understood that the housing assembly 14 may have a different construction if desired. For example, the housing assembly 14 may have a construction similar to the construction disclosed in U.S. Pat. No. 6,308,767.

The housing assembly 14 (FIG. 1) includes an upper housing 28 which encloses the crucible 16. A lower housing 30 is connected to the upper housing 28 and encloses the casting apparatus 18. A flapper or slider valve (not shown) may be provided to block an opening 32 between the upper and lower housings 28 and 30.

The lower housing 30 includes a door 34 which can be opened to have access to the casting apparatus 18. The casting apparatus 18 may be moved into and out of the housing assembly 14 through the door 34. The crucible 16 is a vessel which has a known construction and includes a cavity or chamber 35 which is charged with metal, specifically, nickel chrome super alloy. At least some of this metal may be scrap nickel chrome super alloy from past casting operations.

An induction coil 36 extends around the crucible 16 and is electrically energizable to melt the metal in the chamber 35 of the crucible 16. A pour stopper or valve 37 (FIG. 1) is provided to control the flow of molten nickel chrome super alloy from an opening 38 at a lower end portion of the crucible 16. The pour stopper 37 extends through a cover 39 which provides access to the interior of the upper housing 28.

After the chamber 35 in the crucible 16 has been charged with pieces of metal (nickel chrome super alloy) and with the pour stopper 37 in the closed position illustrated schematically in FIG. 1, the induction coil 36 is energized to melt the metal. During heating of the metal, the interior of the upper and lower housings 28 and 30 are evacuated by connecting the conduits 22 and 24 with a source of low pressure (vacuum). As was previously mentioned, the interior of the upper and lower housings 28 and 30 may be connected with a source of an inert gas rather than a source of low pressure.

After the nickel chrome super alloy scrap metal with which the chamber 35 in the crucible 16 was initially charged has melted, the crucible will contain a molten nickel chrome super alloy 40. The molten nickel super chrome alloy 40 is poured from the crucible 16 to the casting apparatus 18 by raising the pour stopper 37. In order to prevent splashing of the molten nickel chrome super alloy as it is poured from the crucible 16 into the casting apparatus 18, a suitable conduit or trough may be provided to conduct the molten nickel chrome super alloy 40 from the opening 38 at the lower end portion of the crucible 16 to the casting apparatus 18.

Figure 2:
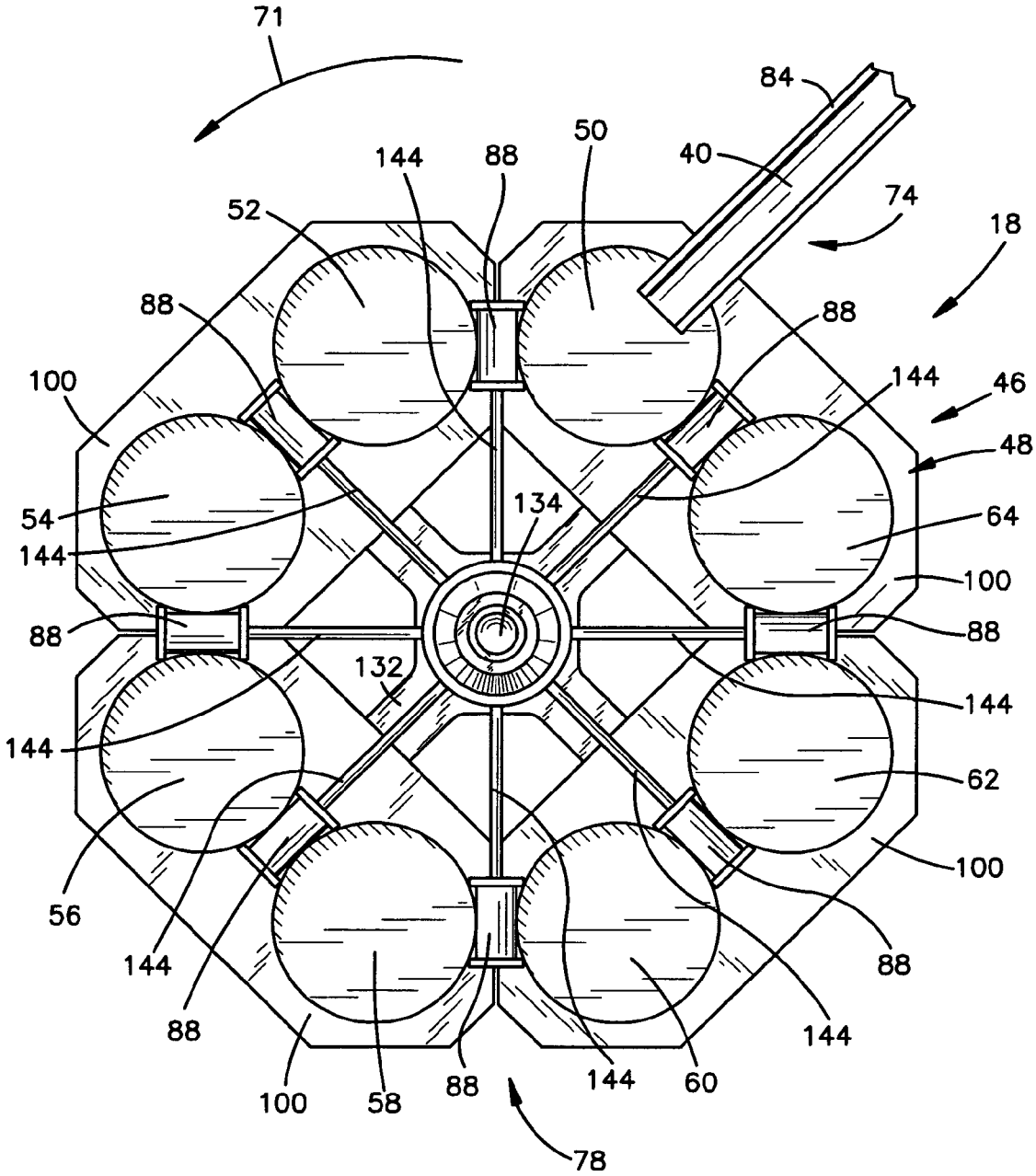
FIG. 2 is an enlarged top plan view, taken generally along the line 2-2 of FIG. 1, illustrating the manner in which molten metal is poured at a pouring station.
Figure 3:
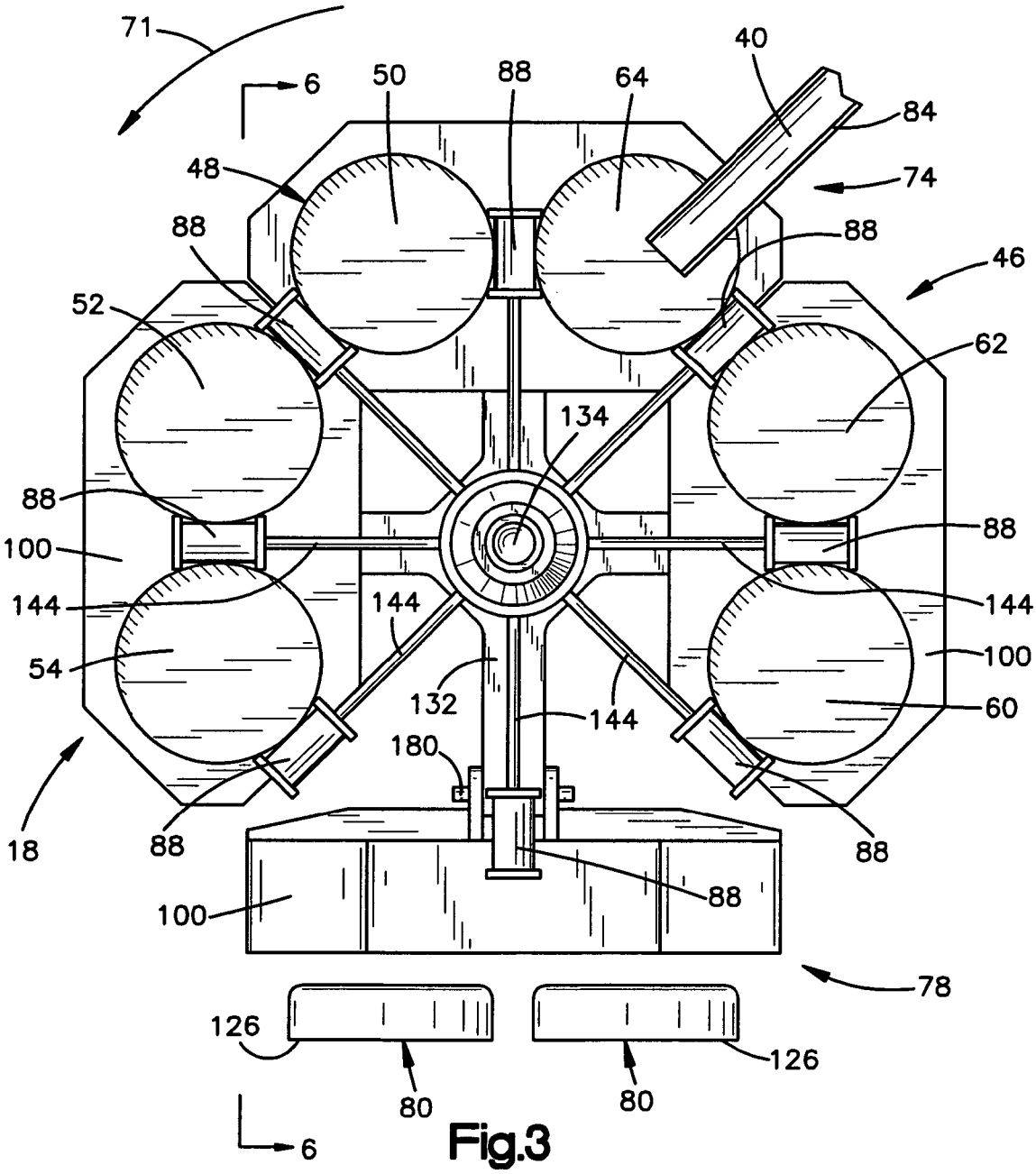
FIG. 3 is a top plan view, generally similar to FIG. 2, illustrating the casting apparatus as cast articles are removed from molds at an article removal station and during the continued pouring of molten metal at the pouring station.

The casting apparatus 18 includes a rotor 46 (FIGS. 1, 2, 3, 5 and 6) on which an array 48 (FIGS. 2 and 3) of molds is disposed. The array 48 of molds on the rotor 46 includes identical molds 50, 52, 54, 56, 58, 60, 62 and 64 (FIGS. 2 and 3). The rotor 46 and the array 48 of molds is rotatably supported on a support section 70 (FIG. 1) of the casting apparatus 18.

Figure 6:
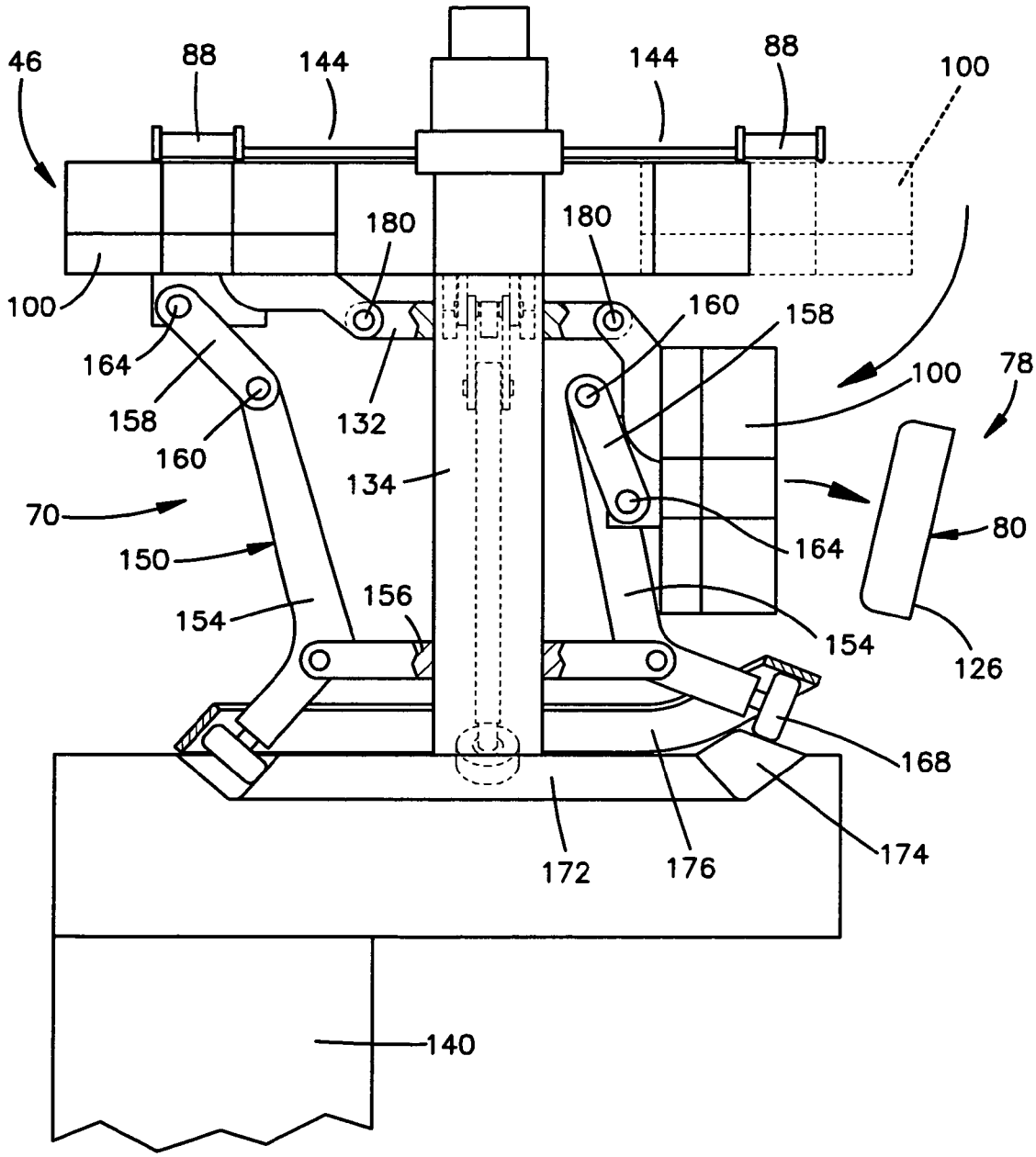
FIG. 6 is a schematic side elevational view, taken generally along the line 6-6 of FIG. 3, illustrating the manner in which articles are removed from molds at the article removal station.

Rotation of the rotor 46 sequentially moves the molds 50-64 through a pouring station 74 (FIGS. 2 and 3) where each of the molds in turn is filled with the molten chrome super alloy 40 from the crucible 16 (FIG. 1). Each of the molds 50-64 is moved in turn from the pouring station 74 (FIG. 2) to an article removal station 78 (FIGS. 3 and 6). At the article removal station 78 cast nickel chrome super alloy articles 80 are removed from the mold.

In FIGS. 2 and 3, the molten nickel chrome super alloy 40 is illustrated as being conducted to the pouring station 74 along an inclined conduit or trough 84. Although it is believed that is may be desirable to have a ramp or trough to conduct the molten nickel chrome super alloy from the opening 26 in the crucible 16 downwardly to the molds 50-64, it should be understood that a different form of conduit may be utilized if desired. Although the illustrated trough 84 has a linear configuration, the trough may have a nonlinear configuration if desired. For example, the trough 84 may have a helical configuration. If desired, heating elements may be provided in the bottom portion of the trough 84. Rather than an open trough, a closed conduit or pipe may be utilized to conduct the molten metal 40.

During pouring of molten nickel chrome super alloy 40 from the crucible 16 (FIG. 1), the pour stopper or valve 37 is pulled upwardly so that the opening 38 is not obstructed by the pour stopper. This results in a continuous flow of molten nickel chrome super alloy from the crucible 16 downwardly to the rotor 46 in the casting apparatus 18. The rotor 46 is continuously rotated at a constant speed relative to the support section 70 and crucible 16 during the continuous flow of molten nickel chrome upper alloy 40 from the crucible 16 to the rotor 46.

Since the rotor 46 is being continuously rotated at a constant speed by an electric motor (not shown) in the support section 70, the molds 50-64 are continuously moving in a counterclockwise direction (as indicated by arrows 71 in FIGS. 2 and 3) along a circular path about the upright central axis of the casting apparatus 18. As each of the molds 50-64, in turn, moves through the pouring station 74, molten nickel chrome super alloy 40 flows from the trough 84 into one of the molds. As the rotor 46 continues to rotate at a constant speed in a counterclockwise direction as viewed in FIGS. 2 and 3, one mold, for example the mold 50 (FIG. 2), is moved away from the pouring station 74 and a next succeeding mold, that is, the mold 64 (FIG. 3), is moved into the pouring station.

Deflectors 88 are provided between the molds to direct the continuous flow of the molten nickel chrome super alloy 40 to first one and then into a next succeeding adjacent one of the molds 50-64. The deflectors 88 are continuously rotated along a circular path, in a counterclockwise direction as viewed in FIGS. 2 and 3, with the molds 50-64. Thus, the rotor 46 moves from the position shown in FIG. 2 to the position shown in FIG. 3, the deflector 88 between the leading mold 50 and the next adjacent trailing mold 64 is first effective to deflect molten nickel chrome super alloy 40 from the trough 84 into the mold 50 and is then effective to deflect molten nickel chrome super alloy 40 from the trough 84 into the mold 64.

The deflectors 88 are disposed midway between adjacent molds and are rotated with the molds. Therefore, each deflector 88 is effective to first direct molten nickel chrome super alloy 40 into a leading mold and then into a trailing mold adjacent to the leading mold. The drive motor in the support section 70 rotates the deflectors 88 in the same direction and at the same speed as the molds 50-64. The deflectors 88 do not move relative to each other.

In the illustrated embodiment of the invention, there is a continuous pouring of molten metal that is the nickel chrome super alloy 40, from the crucible 16 into the molds 50-64. The molds 50-64 are continuously moved, at a constant speed, along circular path by a drive assembly disposed in the support section 70 of the casting apparatus 18. However, it should be understood that the flow of molten metal from the crucible 16 may be interrupted and/or the rotational movement of the rotor 46 interrupted.

If the rotational movement of the rotor 46 is to be interrupted, an intermittent drive mechanism may be provided in the support section 70. This intermittent drive mechanism may include a geneva drive or other known type of intermittent drive mechanism. Alternatively, a clutch and brake assembly may be utilized to connect the drive motor with the rotor 46. If this was done, the clutch would be periodically operated between the engaged and disengaged conditions.

It is also contemplated that rather than having a constant flow of molten nickel chrome super alloy 40 from the crucible 16 downward to the casting apparatus 18, the flow of molten metal may be periodically interrupted by moving the pour stopper 37 from an open position to a closed position in which the pour stopper blocks the opening 38 in the bottom of the crucible 16. If this is done, the pour stopper 37 would be in the closed position blocking the flow of molten metal when the rotor 46 is moving. The pour stopper 37 would be in the open position enabling a flow of molten metal when the rotor 46 is stationary. Rather than having a pour stopper to control a flow of molten metal through the opening 38 in the crucible 16, the crucible 16 may be tilted or rocked to pour molten metal.

The cast articles 80 are removed from the molds 50-64 and are dropped onto a receiving tray or bin 94 (FIG. 1). The receiving tray or bin 94 is disposed directly beneath the casting apparatus 18 and the cast nickel chrome super alloy articles 80 are dropped onto the tray 94. The door 34 to the housing 14 may be periodically opened to remove the tray 94 and the cast articles 80 therein from the housing assembly 14. Rather than having a receiving tray 94 beneath the casting apparatus 18 to receive the cast metal articles 80, a conveyor may be utilized to move the cast articles to a desired location.

Casting Apparatus

The illustrated casting apparatus 18 includes the rotor 46 having a plurality of solid metal support sections 100 (FIGS.

2 and 3) on which the molds 50-64 are disposed. Although the molds 50-64 may be formed separately from the support sections 100, the molds 50-64 are integrally formed as one piece with the support sections 100. The molds 50-64 are cooled by conducting a flow of cooling fluid (water) through the metal support sections 100. The rate of heat transfer to the cooling fluid is sufficient to cause solidification of the molten nickel chrome super alloy in the molds 50-64 as they move from the pouring station 74 to the article removal station 78 without melting of the metal support sections 100.

Although the molds 50-64 are integrally formed as one piece with the metal support sections 100, it is contemplated that the molds 50-64 may be formed separately from the support sections 100. Thus, each mold 50-64 may be formed separately from the support sections 100. Once the separate molds 50-64 have been formed, they may be mounted on the support sections. This would enable the support sections 100 to be formed of one material, for example metal, and the molds 50-64 to be formed of another material, for example a ceramic. Heat would be transmitted from the molds 50-64 to the fluid cooled support sections 100 to promote solidification of molten metal 40 in the molds.

Although two molds are mounted on each of the support sections 100 in the embodiment of the invention illustrated in FIGS. 2 and 3, a greater or lesser number of molds may be provided on each of the support sections. For example, only a single mold, for instance the mold 50, may be disposed on a support section. The mold 50 may be integrally formed as one piece with a support section on which it is disposed or may be formed separately from the support section. As a further example, three or more molds may be disposed on a support section 100. These molds, that is, three or more, may be integrally formed as one piece with the support section 100 or formed separately from the support section.

Although the molds 50-64 may have a different construction, in the illustrated embodiment of the invention, each of the molds is integrally formed as one piece with a support section 100. Thus, the support section 100 is a piece of metal, that is, copper, in which one or more of the molds 50-64 is formed. By integrally forming each of the molds 50-64 as one piece with a support section 100, cooling of the molds by a flow of cooling fluid, such as water, through the metal support sections 100 is promoted. The metal support sections 100 provide for a high rate of heat transfer between the molten nickel chrome super alloy 40 in a mold and the cooling fluid being conducted through the support section for the mold. A greater or lesser number of support sections 100 may be provided in the casting apparatus 18.

Figure 4:
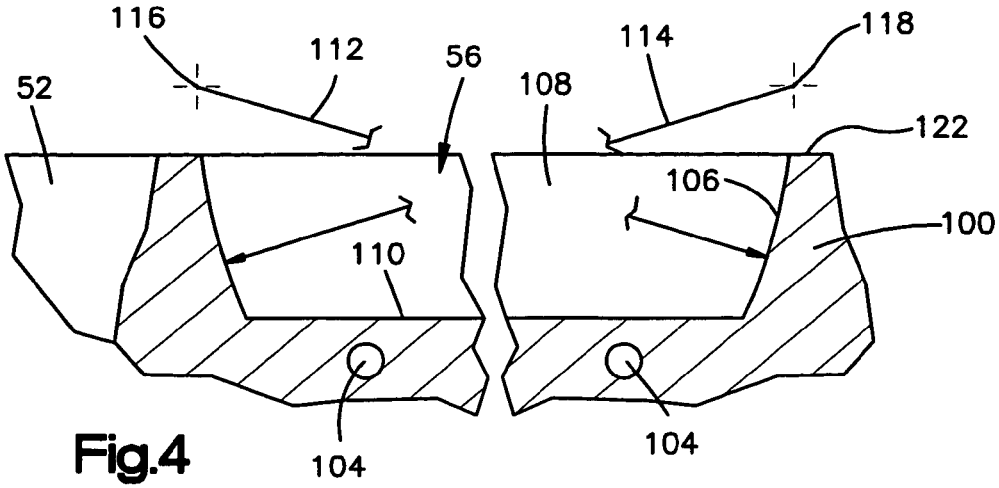
FIG. 4 is a fragmentary schematic illustration depicting the radius of curvature of a side wall or surface of a mold cavity in the casting apparatus of FIGS. 1-3.

The relationship between the mold 50, the support section 100 and a cooling fluid passage 104 is illustrated schematically in FIG. 4. The cooling fluid passage 104 is formed in the metal of the support section 100 in which the mold 50 is disposed. Of course, the cooling fluid passages 104 may be formed by conduits which are separate from and mounted on or in the support section 100. Flexible conduits (not shown) are provided to connect the cooling fluid passages 104 with a source of cooling fluid. The flexible conduits accommodate movement of the support sections 100 between the pouring and article removal positions.

Although only the cooling fluid passages 104 associated with the mold 50 have been illustrated schematically in FIG. 4, it should be understood that there are cooling fluid passages associated with each of the molds 50-64. In the illustrated embodiment of the invention, the cooling fluid passages for the molds 50-64 are formed in the support sections 100 associated with the molds.

Although only two cooling fluid passages 104 have been illustrated in FIG. 4 as being associated with the mold 50, it should be understood that a greater or lesser number of cooling fluid passages may be provided in association with the mold 50. For example, a cooling fluid passage may be disposed adjacent to and extend around a circular side surface 106 of a mold cavity 108 rather than being disposed adjacent to the circular bottom surface 110. Of course, the number of cooling fluid passages associated with a mold 50 may be greater than the number illustrated in FIG. 4.

The circular side surface 106 of the mold cavity 108 has a uniformly curving arcuate configuration throughout the extent of the side surface. The uniform radius of curvature of the side surface 106 is indicated schematically by arrows 112 and 114 in FIG. 4. The centers of curvature of the arcuate side surface 106 have been indicated at 116 and 118 in FIG. 4. It should be noted that the centers of curvature for the arcuate circular side surface 106 are disposed above (as viewed in FIG. 4) an upper major side surface 122 of the support section 100. The arcuate side surface 106 of the mold cavity 108 has a constant radius of curvature which is larger than the diameter of the circular mold cavity 108.

By having the radius of curvature of the arcuate side surface 106 in the mold cavity 108 greater than the radius of the circular mold cavity 50, removal of a cast nickel chrome super alloy article 80 from the mold cavity 108 is facilitated. This is because an upper (as viewed in FIG. 4) circular corner 126 (FIG. 3) of the cast nickel chrome super alloy article 80 tends to move clear of the arcuate side surface 106 of the mold cavity 108 as the cast nickel chrome super alloy article falls downwardly out of the mold cavity 108. When the article 80 moves downwardly out of the mold cavity 108 under the influence of gravity at the article removal station 78 (FIGS. 3 and 6), the circular corner 126 moves away from the axially outwardly flaring side surface 106 (FIG. 4) of the mold cavity 108.

In order to have clearance between the corner 126 of the cast nickel chrome super alloy article 80 and the arcuate side surface 106 of the mold cavity 108 increase as the cast nickel chrome super alloy article moves out of the mold under the influence of gravity, the center of curvature of the arcuate side surface 106 of the mold is disposed above (as viewed in FIG. 4) and outwardly of the open end portion of the open end of the mold cavity 108, that is, the end portion of the mold cavity opposite from the bottom surface 110. The combination of having the radius of curvature of the side surface 106 greater than the radius of the circular opening to the mold cavity 108 and having a center of curvature disposed outwardly (above as viewed in FIG. 4) of the circular open end of the mold cavity enables the clearance between the outer side surface of the cast nickel chrome super alloy article 80 and the arcuate side surface 106 of the mold cavity 108 to increase as the cast nickel chrome super alloy article moves outwardly away from the circular bottom surface 110 of the mold cavity. The larger the radius of curvature of the arcuate side surface 106 of the mold cavity 108, the closer is the side surface 106 of the mold cavity 108 to a cylindrical configuration. By having the configuration of the cast nickel chrome super alloy article 80 and the mold cavity 108 approach a cylindrical configuration, the amount of waste space which is present when a crucible is charged with the cast nickel chrome super alloy articles 80 is reduced.

However, the arcuate side surface 106 of the mold cavity 108 can not be cylindrical and still have increasing clearance between the side surface of the mold and the side surface of the cast nickel chrome super alloy article 80 as the article moves out of the mold. Therefore, it is believed that it may be desired to have the arcuate side surface 106 of the mold cavity 108 formed with a radius of curvature which is the same as or greater than the diameter of the mold cavity. In addition, it is believed that the side surface 106 of the mold cavity 108 may advantageously have a center of curvature which is offset from the mold cavity in the direction of movement of the nickel chrome super alloy article 80 from the mold cavity.

The rotor 46 includes a generally X-shaped base 132 (FIGS. 2 and 3). The base 132 is fixedly connected to a central shaft 134 which is rotatable by a drive assembly 140 (FIG. 6). The drive assembly 140 includes an electric motor which is operable to rotate the central shaft 134 and the base 132 together about a vertical (as viewed in FIGS. 5 and 6) central axis of the central shaft. The drive assembly 140 is disposed in the support section 70 (FIG. 1) of the casting apparatus 18.

The drive assembly 140 (FIG. 6) is operable to rotate the central shaft 134 and base 132 of the rotor 46 at a constant speed during continuous pouring of molten metal from the crucible 16 (FIG. 1) into the molds 50-64. Each of the molds 50-64 is filled in turn with molten metal as it moves through the pouring station 74 (FIG. 2). Cast nickel chrome super alloy articles 80 are removed from the molds 50-64 as they move through the article removal station 78. The cast nickel chrome super alloy articles 80 drop from the molds 50-64 at the article removal station 78 as the support section 100 for a pair of the molds is tilted downward (in the manner illustrated schematically in FIGS. 3 and 6).

The arcuately curving deflectors 88 rotate with the molds 50-64 at the same speed as the molds. Each of the deflectors 88 (FIGS. 2 and 3) is mounted on a support shaft 144 which extends radially outward from the central shaft 134. Radially inner end portions of the support shafts 144 are fixedly connected with the central shaft 134 for rotation therewith. Radially outer end portions of the support shafts 144 are fixedly connected to the deflectors 88.

The support sections 100 are pivotal between the pouring position illustrated in FIG. 3 in association with the molds 50-54 and 60-64 and the article removal position illustrated in FIG. 3 in association with the molds 58 and 60. The positions of the deflectors 88 relative to the molds 50-64 remains constant until the molds move to the article removal station 78. As the molds, for example the molds 56 and 58 (FIG. 2) enter the article removal station 78, the support section 100 pivots downwardly (as viewed in FIGS. 3, 5 and 6) about a horizontal axis to enable the cast nickel chrome super alloy articles 80 (FIG. 3) to fall out of the molds disposed on the downwardly pivoting support section.

When the support section 100 for the molds 56 and 58 has moved into the article removal station 78 and pivoted to the orientation illustrated in FIG. 6, the cast nickel chrome super alloy articles 80 (FIG. 3) move out of the article molds under the influence of gravity. As the support section 100 pivots downwardly at the article removal station 78, the deflectors 88 associated with the support section do not move downwardly with the support section (FIG. 6). Thus, all of the deflectors continue to move along a circular path and maintain the same orientation relative to the central shaft 134 as a support section 100 pivots downwardly to the article removal orientation illustrated in FIGS. 3 and 6 for the support section 100 associated with the molds 56 and 58.

Figure 5:
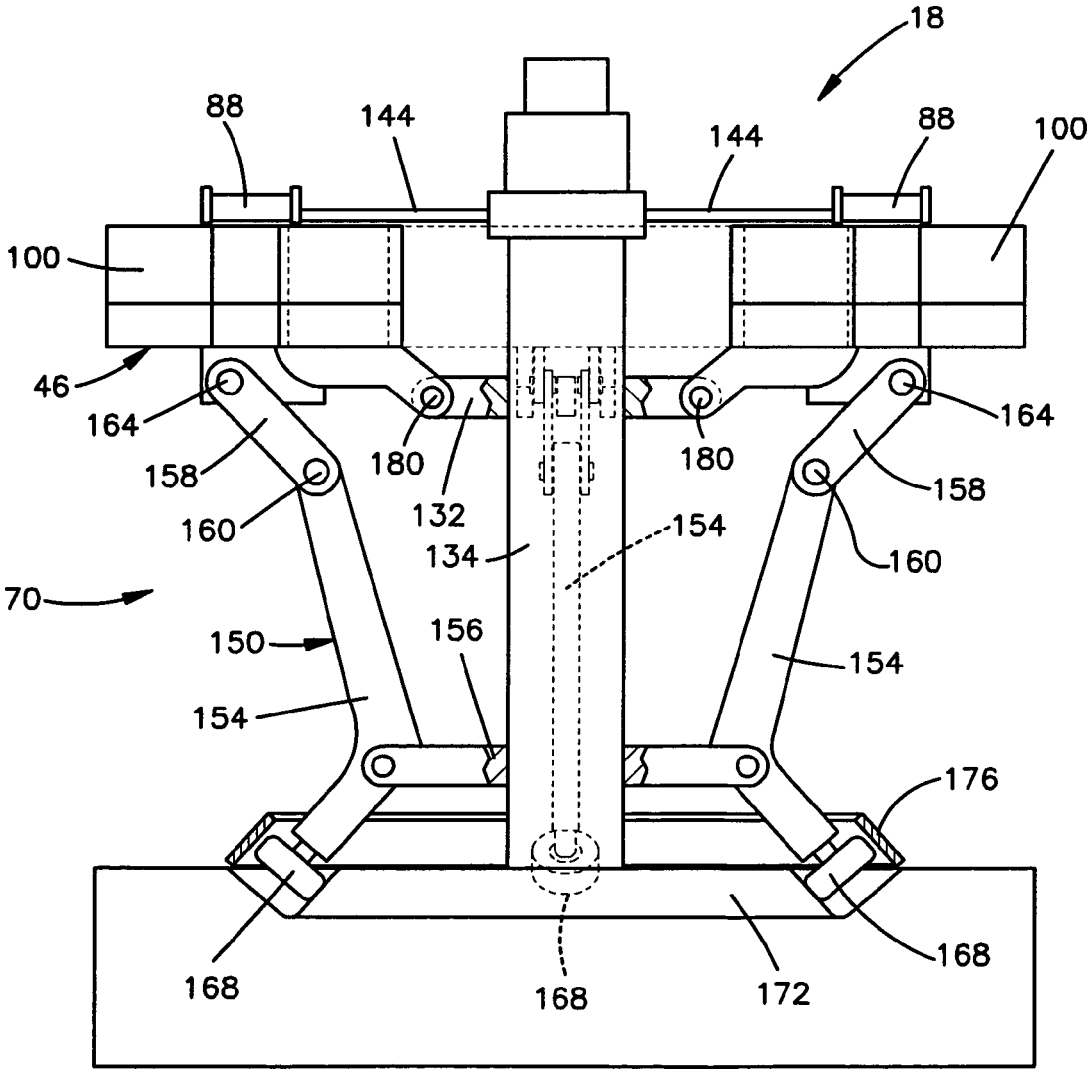
FIG. 5 is a schematic side elevational view, taken generally along the line 5-5 of FIG. 3, illustrating the manner in which molds are supported during rotation of the molds.

Each of the support sections 100 is supported in the pouring position illustrated in FIG. 2 by a linkage assembly 150 (FIG. 5). The linkage assembly 150 (FIG. 6) is operated to release a support section 100 for movement to the cast article removal position illustrated for a support section and associated molds 56 and 58 in FIGS. 3 and 6. The linkage assembly 150 (FIG. 5) includes a main link 154 which is pivotally mounted on a support bracket 156. The support bracket 156 is fixedly connected to and rotates with vertical the central shaft 134.

In addition, the linkage assembly 150 includes a connector link 158. The connector link 158 has a lower end portion which is pivotally connected at 160 to the upper end portion of the main link 154. The connector link 158 has an upper end portion which is pivotally connected at 164 to one of the support sections 100.

The main link 154 has a lower end portion on which a circular cam follower 168 (FIG. 6) is mounted. During movement of the molds 56 and 58 (FIG. 2) from the pouring position in which they are filled with molten nickel chrome super alloy 40 at the pouring station 74 to the article removal station 78, the cam follower 168 engages a stationary lower track 172. The stationary lower track 172 has a uniform circular configuration and extends from one side of the article removal station 78 to the opposite side of the article removal station 78. At the article removal station 78, there is a stationary cam section 174 (FIG. 6) in the lower track 172.

As the rotor 46 is rotated by the central shaft 134, the cam follower 168 moves into alignment with the cam section 174 in the lower track 172. The cam follower 168 is moved upwardly (as viewed in FIG. 6) by the cam section 174. When this occurs, the weight of the support section 100 for the molds 56 and 58 (FIG. 6) urges the main link 154 to pivot in a counterclockwise direction (as viewed in FIG. 5) about a horizontal axis. Counterclockwise rotation of the main link 154 is limited by engagement of the cam follower 168 with a stationary upper track 176. The upper track 176 extends along and is uniformly spaced from the lower track 172. The lower track 172 and upper track 176 cooperate to guide movement of the cam follower 168.

The force resulting from the weight of the support section 100 and molds 56 and 58 is transmitted through the connector link 158 to the upper end portion of the main link 154. This force causes the upper end portion of the main link 154 to move inward toward the central shaft 134 (FIG. 6). As this occurs, the support section 100 for the molds 56 and 58 pivots downwardly from the pouring position illustrated in FIGS. 2 and 5 to the article removal position illustrated in FIGS. 3 and 6.

Each of the support sections 100 is pivotally connected to a radially outer end portion of a horizontal arm of the base 132 by a pivot connection 180 (FIG. 3). Although only the pivot connection 180 for the support section 100 associated with the molds 56 and 58 is illustrated in FIG. 3, it should be understood that each of the support sections 100 is pivotally connected to an arm of the base 132 at a pivot connection corresponding to the pivot connection 180.

In the embodiment of the invention illustrated in FIGS. 2-6, the casting apparatus 18 utilizes the linkage assembly 150 and track 172 to control movement of the support sections 100 between the pouring position (FIG. 3) and the article removal position (FIGS. 2 and 5) for the support section 100 associated with the molds 56 and 58. However, it is contemplated that the support sections 100 may be moved in a different manner if desired. For example, electric, pneumatic, and/or hydraulic motors may be associated with the support sections to effect movement of the support sections. Alternatively, the linkage assembly 150 may be provided with a projection which is actuated by engagement with a stationary control element to effect movement of the linkage assembly from the extended condition illustrated in FIG. 5 in which the support sections 100 are held in the pouring position to the article removal position illustrated for the support section 100 associated with the molds 56 and 58 in FIGS. 3 and 6.

In the illustrated embodiment of the invention, a plurality of deflectors are moved with the molds 50-64 during rotation of a rotor 46. However, it is contemplated that the deflectors may be mounted in a different manner. For example, a single deflector 88 may be provided in association with the pouring station 74. When a single deflector 88 is utilized, the deflector may be moved relative to the pouring station 74 between a retracted position in which the deflector is ineffective to deflect a flow of molten metal from the trough 84 and an extended position in which the deflector is effective to deflect the flow of molten metal from the trough 84. Although the deflectors 88 are fixedly connected to the support shafts 144, it is contemplated that the deflectors 88 may be movable axially along the support shafts between the extended position illustrated in FIG. 3 and a retracted position.

The illustrated deflectors 88 have a metal core which is formed as half of a cylinder. This core is lined with a semi circular layer of ceramic material which is engaged by the molten nickel chrome super alloy 40. Of course, the deflectors 88 may be constructed in a different manner if desired. For example, the deflectors 88 may be formed of a solid piece of ceramic material.

Although the drive assembly 140 is continuously operated to rotate the rotor 46 at a constant speed, it is contemplated that the drive assembly 140 may be intermittently operated. If this is done, operation of the drive assembly 140 and rotation of the rotor 46 would be interrupted each time one of the molds 50-64 moves into the pouring station 74. Operation of the drive assembly 140 would be interrupted long enough to allow one of the molds 50-64 as the pouring station 74 to be filled with molten metal 40. Operation of the drive assembly 140 would then be resumed to move the next succeeding mold to the pouring station 74. Operation of the drive assembly 140 would again be interrupted for a length of time sufficient to enable the next succeeding mold to be filled with molten metal 40.

If the drive assembly 140 is intermittently operated to intermittently rotate the rotor 46, molten nickel chrome super alloy 40 may be intermittently poured from the crucible 16. If this is done, the pouring of molten nickel chrome super alloy 40 from the crucible 16 would occur when rotation of the rotor 46 is interrupted by interrupting operation of the drive assembly 140. The pouring of molten nickel chrome super alloy 40 from the crucible 16 would be interrupted during rotation of the rotor 46. However, it should be understood that there may be a continuous pouring of nickel chrome super alloy 40 from the crucible 16 even though there is intermittent rotation of the rotor 46.

Figure 7:
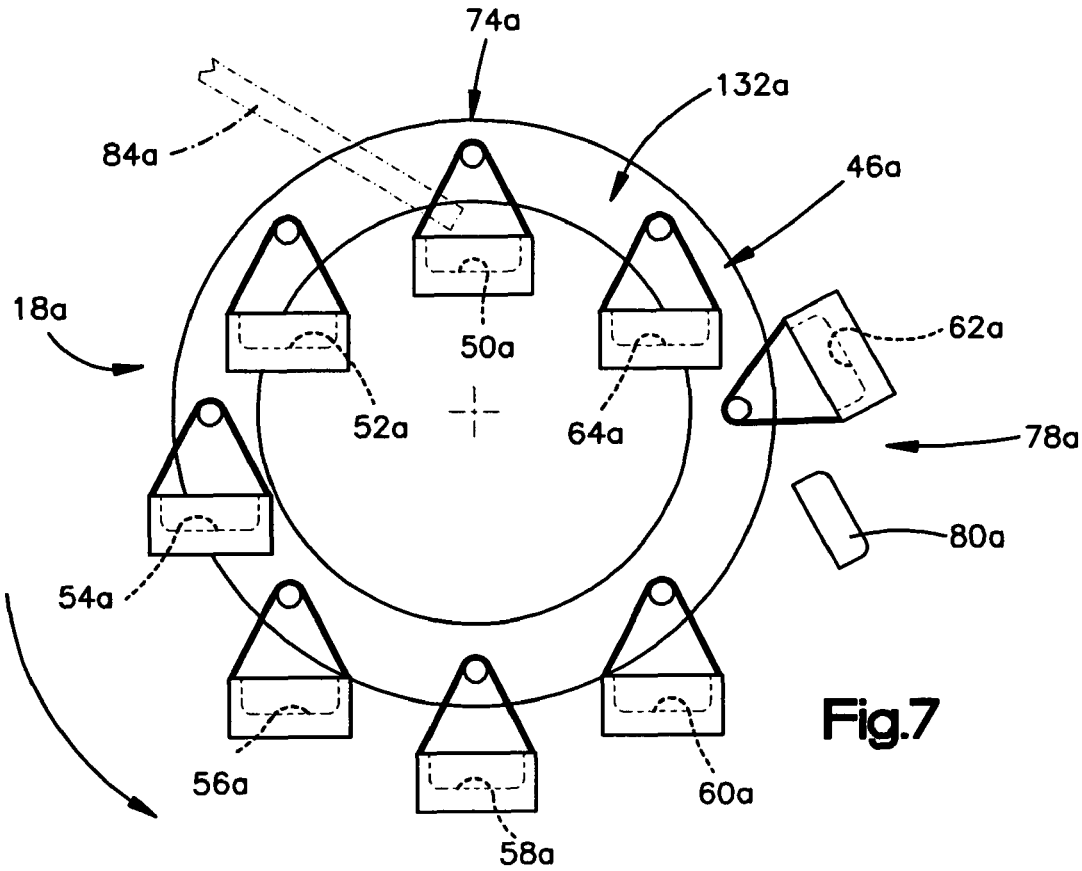
FIG. 7 is a schematic illustration depicting the construction of an embodiment of the casting apparatus in which molds are rotated about a horizontal axis.

Embodiment of FIG. 7

In the embodiment of the invention illustrated in FIGS. 2-6, the molds 50-64 are rotatable about a vertical axis. In the embodiment of the invention illustrated in FIG. 7, the casting apparatus is rotatable about a horizontal axis. Since the embodiment of the invention illustrated in FIG. 7 is generally similar to the embodiment of the invention illustrated in FIGS. 2-6, similar numerals will be utilized to designate similar components, the suffix letter "a" being associated with the numerals of FIG. 7 to avoid confusion.

A casting apparatus 18*a* includes a base 132*a* which is rotatable about a horizontal axis. A plurality of molds 50*a*-64*a* are pivotally mounted on the base 132*a*. The base 132*a* is rotatable about a horizontal axis to sequentially move the molds in a counterclockwise direction (as viewed in FIG. 7) from a pouring station 74*a* to an article removal station 78*a*. At the pouring station 74*a*, the molds 50*a*-64*a* are sequentially filled with molten nickel chrome super alloy conducted from a crucible, corresponding to the crucible 16 of FIG. 1, along a conduit 84*a*. The conduit 84*a* may be a trough, as illustrated schematically in FIGS. 2 and 3. However, the conduit 84*a* may have a different construction if desired.

The molds 50*a*-64*a* are pivotal, about horizontal axes, relative to the base 132. The molds 50*a*-64*a* remain in an upright orientation as they move from the pouring station 74*a* to the article removal station 78*a*. Each mold 50*a*-64*a* is pivoted in turn at the article removal station remove a cast article 80*a* from the mold. The mold 64*a* is illustrated in FIG. 7 as being pivoted to enable a cast nickel chrome super alloy article 80*a* to fall downwardly (as viewed in FIG. 7) out of the mold.

The molds 50*a*-64*a* may be sequentially pivoted at the article removal station 78*a* by a cam follower which is connected with the mold and engages a stationary cam track. Of course, the mold 64*a* may be pivoted at the article removal station 78*a* in a different manner if desired. As each of the molds 50*a*-64*a* moves through the article removal station 78*a* in turn, each of the molds is pivoted relative to the base 132*a*.

Although only a single base 132*a* is illustrated in FIG. 7, it is contemplated that the casting apparatus 18*a* may have a construction similar to the construction of a Ferris wheel. Thus, the casting apparatus 18*a* may have a second annular base which is disposed in a coaxial relationship with the illustrated base 132*a*. The molds 50*a*-64*a* may be pivotally suspended between the two bases 132*a* in much the same manner as in which seats of a ferris wheel are pivotally suspended between a pair of base members. Of course, the two base members 132*a* are interconnected so that they rotate together about their common central axis.

The molds 50*a*-64*a* are cooled by a flow of cooling fluid (water) through passages connected with the molds. The cooling fluid passages connected with the molds 50*a*-64*a* are connected with a source of cooling fluid through conduits which accommodate the pivotal movement of the molds. The cooling fluid conduit may include flexible sections and/or swivel connections which accommodate pivotal movement of the molds 50*a*-64*a*.

Figure 8:
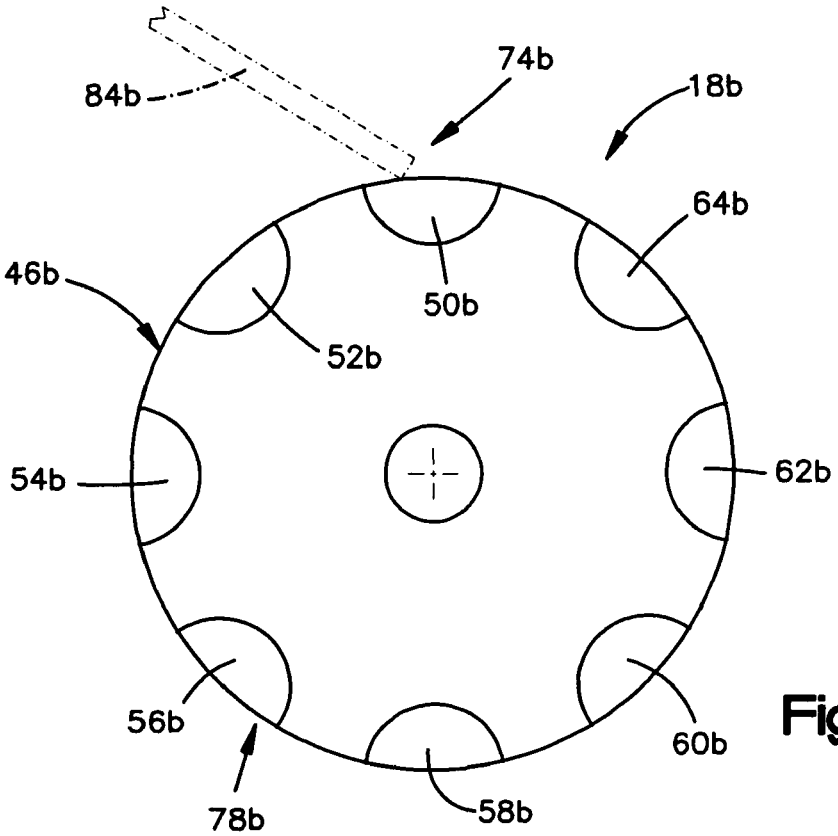
FIG. 8 is a schematic illustration of another embodiment of the invention in which the molds are rotated about a horizontal axis.

Embodiment of FIG. 8

In the embodiments of the invention illustrated in FIGS. 2-7, the molds are pivotal relative to a rotatable base. In the embodiment of the invention illustrated in FIG. 8, the molds are integrally formed as one piece with the rotatable base. Since the embodiment of the invention illustrated in FIG. 8 is generally similar to the embodiment of the invention illustrated in FIGS. 1-7, similar numerals will be utilized to designate similar components, the suffix letter "b" being associated with the numerals of FIG. 8 to avoid confusion.

A casting apparatus 18*b* includes a metal rotor 46*b* in which molds 50*b*, 52*b*, 54*b*, 56*b*, 58*b*, 60*b*, 62*b*, and 64*b* are formed. The molds 50*b*-64*b* are sequentially filled with molten nickel chrome super alloy at a pouring station 74*b*. Cast metal articles, corresponding to the cast metal articles 80 of FIG. 2, are removed from the molds at an article removal station 78*b*.

Molten nickel chrome super alloy is conducted to the molds at the pouring station 74*b* through a conduit 84*b*. The conduit 84*b* may be a trough, corresponding to the trough 84 illustrated schematically in FIGS. 2 and 3. Of course, the conduit 84*b* may have a different construction if desired.

The rotor 46*b* is formed as a single piece of metal in which the molds 64*b* are formed. The single piece of metal forming the rotor 46*b* is cooled to promote solidification of the molten nickel chrome super alloy in the molds 50*b*-64*b*. There are cooling fluid (water) flow passages formed in the rotor 46*b*. A plurality of deflectors, corresponding to the deflectors 88 of FIGS. 2-6, may be provided in association with the molds 50*b*-64*b*. Thus, a single deflector may be provided between each adjacent pair of molds. Alternatively, a single deflector may be utilized at the pouring station 74*b* if desired.

The rotor 46*b* may be continuously or intermittently rotated. Similarly there may be continuous or intermittent pouring of molten nickel chrome super alloy. For example, if rotation of the rotor 46*b* is interrupted each time one of the molds 50*b*-64*b* is moved to the pouring station 74*b*, there may be with continuous or intermittent pouring of the molten nickel chrome super alloy. Assuming a continuous pouring of the molten nickel chrome super alloy, deflectors, corresponding to the deflectors 88, may be utilized in association with the molds 50*b*-64*b*.

CONCLUSION

The present invention relates to a method of casting nickel chrome super alloy articles 80. A plurality of molds 50-64 are disposed on a rotatable base 132. The base 132 is rotated to move each of the molds 50-64, in turn, through a pouring station 74 to an article removal station 78 and back to the pouring station. A molten nickel chrome super alloy 40 is poured into each of the molds 50-64 in turn at the pouring station 74. Cast nickel chrome super alloy articles 80 are removed from the molds 50-64 at the article removal station 78.

The molds 50-64 may be continuously rotated. Molten metal 40 may be continuously poured into the molds as they are rotated. Deflectors may be associated with the molds to deflect molten metal 40 during rotation of the molds and pouring of the molten metal. Alternatively, the molds 50-64 may be intermittently rotated. If this is done, molten metal 40 would be poured while the molds 50-64 are stationary.

The present invention includes a plurality of features which may be utilized together in a manner described herein. Alternatively, these features may be used separately and/or in combination with features from the prior art.

Having described the invention, the following is claimed:

1. A method of casting nickel chrome super alloy articles, said method comprising the steps of:

providing a rotatable base on which a plurality of molds are disposed;

rotating the base to move each of the molds in turn through a pouring station to an article removal station and back to the pouring station;

pouring a molten nickel chrome super alloy into each of the molds in turn at the pouring station, said step of pouring a molten nickel chrome super alloy includes pouring the molten nickel chrome super alloy during performance of said step of rotating the base;

cooling the molds containing the molten nickel chrome super alloy by conducting a flow of cooling fluid to and from the molds containing the molten nickel chrome super alloy; and removing cast nickel chrome super alloy articles from the molds at the article removal station.

2. A method as set forth in claim 1 wherein said step of rotating the base to move each of the molds in turn through a pouring station to an article removal station and back to the pouring station includes continuously rotating the base as each mold in turn moves through the pouring station, through the article removal station and back to the pouring station, said step of pouring a molten nickel chrome alloy into each of the molds in turn at the pouring station includes at least partially filling each of the molds in turn with molten metal while the rotational movement of the base continues.

3. A method as set forth in claim 1 wherein said step of pouring a molten nickel chrome super alloy includes continuously pouring the molten nickel chrome super alloy during at least one complete revolution of the base.

4. A method as set forth in claim 3 further including the step of deflecting a stream of molten metal away from a first mold toward a second mold with a deflector as the first mold moves away from the pouring station and the second mold moves toward the pouring station.

5. A method as set forth in claim 4 further including the step of moving the deflector with the first and second molds during rotation of the base.

6. A method as set forth in claim 1 wherein said step removing a cast nickel chrome super alloy article from the molds at the article removal station includes pivoting at least one mold about an axis which extends transverse to an axis about which the base rotates.

7. A method as set forth in claim 1 wherein said step of pouring nickel chrome super alloy into each of the molds in turn includes continuously pouring molten metal as a plurality of molds sequentially move through the pouring station, said method further includes providing deflectors between adjacent molds in the array of molds and deflecting molten metal into each of the molds in turn with the deflectors as each mold moves into and out of the pouring station, said step of rotating the base includes moving the deflectors and molds along an arcuate path.

8. A method as set forth in claim 7 wherein said step of removing a cast nickel chrome super alloy article from the molds at the article removal station includes moving the molds relative to the deflectors.

9. A method as set forth in claim 1 wherein said step of rotating the base includes rotating the base about a vertical axis.

10. A method as set forth in claim 9 wherein said step of removing cast nickel chrome super alloy articles from the molds at the article removal station includes pivoting a first mold about a horizontal axis while the first mold is being rotated about the vertical axis.

11. A method as set forth in claim 9 wherein said step of removing a nickel chrome super alloy article from the molds at the article removal station includes simultaneously pivoting a plurality of molds about a horizontal axis while the plurality of molds are being rotated about the vertical axis.

12. A method as set forth in claim 1 wherein said step of rotating the base includes rotating the base about a horizontal axis.

13. A method as set forth in claim 1 wherein said step of removing a cast nickel chrome super alloy article from the molds includes sliding an arcuate other side surface area on a circular article along an arcuate side surface area formed on the mold, the arcuate side surface area on the mold having an arc of curvature which has a radius which is greater than a radius of the circular article.

14. A method as set forth in claim 1 further including the step of maintaining the molds in either an evacuated or inert gas environment during performance of said step of rotating the base to move each of the molds in turn through a pouring station to an article removal station and back to the pouring station.

15. A method as set forth in claim 1 wherein said step of rotating the base to move each of the molds in turn through a pouring station to an article removal station and back to the pouring includes moving each of the molds along a circular path at a constant speed, said step of pouring a molten nickel chrome super alloy into each of the molds in turn at the pouring station includes maintaining a continuous flow of molten nickel chrome alloy to the pouring station during movement of the molds along the circular path.

16. A method as set forth in claim 1 wherein said step of rotating the base to move each of the molds in turn through a pouring station includes moving a plurality of deflectors along with the molds with each deflector being disposed between adjacent molds of the plurality of molds, said step of pouring a molten nickel chrome super alloy into each of the molds in turn includes deflecting the molten nickel chrome super alloy with each of the deflectors in turn as one mold moves away from the pouring station and a next succeeding mold moves into the pouring station.

17. A method as set forth in claim 16 wherein said step of removing a cast nickel chrome super alloy article from the molds at the article removal station includes providing relative movement between at least one of the molds and at least one of the deflectors.

18. A method as set forth in claim 1 wherein said step of rotating the base to move each of the molds in turn through a pouring station to an article removal station and back to the pouring station includes interrupting rotation of the base with each mold in turn at the pouring station, said step of pouring a molten nickel chrome alloy into each of the molds in turn at the pouring station includes at least partially filling each of the molds in turn with molten metal while the mold is stationary at the pouring station.

19. A method as set forth in claim 1 wherein pouring of the molten nickel chrome super alloy is interrupted during rotation of the base.

20. A method of casting nickel chrome super alloy articles, said method comprising the steps of:

melting nickel chrome super alloy in a first housing, continuously conducting a flow of molten nickel chrome super alloy from the first housing into molds in a second housing, continuously moving the molds in the second housing along a circular path during a flow of molten nickel chrome super alloy from the first housing, said step of moving the molds along a circular path includes sequentially moving the molds through a pouring station, through an article removal station and back to the pouring station, at least partially filling each of the molds in turn at the pouring station with molten nickel chrome super alloy flowing from the first housing into the second housing, said step of at least partially filling each of the molds at the pouring station is performed during movement of the molds along the circular path, and deflecting molten metal away from a mold leaving the pouring station and toward a mold entering the pouring station as each mold in turn enters and leaves the pouring station during movement of the molds along the circular path, and removing cast nickel chrome super alloy articles from the molds at the article removal station during movement of the molds along the circular path.

21. A method as set forth in claim 20 further including the step of moving a plurality of deflectors along the circular path with the molds, said step of deflecting molten metal is performed with each of said deflectors in turn.

22. A method as set forth in claim 20 further including the step of cooling the molds containing the molten nickel chrome super alloy by conducting a flow of cooling fluid to and from the molds containing the molten nickel chrome super alloy.

* * * * *